166-250 SR
FIP8011 XR 4,018,276

United States Patent [19]

Bode

[11] 4,018,276

[45] Apr. 19, 1977

[54] BLOWOUT PREVENTER TESTING APPARATUS

[75] Inventor: Robert Euland Bode, Monikie, Scotland

[73] Assignee: Continental Oil Company, Ponca City, Okla.

[22] Filed: June 14, 1976

[21] Appl. No.: 695,340

[30] Foreign Application Priority Data

Mar. 19, 1976 United Kingdom ..... 11235/76

[52] U.S. Cl. ..... 166/183; 73/40.5 R; 166/129; 166/250

[51] Int. Cl.[2] ..... E21B 23/00; E21B 33/12

[58] Field of Search ..... 166/70, 85, 87, 129, 166/188, 250, 196, 183; 73/40.5; 285/100

[56] References Cited

UNITED STATES PATENTS

| | | | |
|---|---|---|---|
| 2,216,336 | 10/1940 | Barnes et al. | 166/196 |
| 3,177,703 | 4/1965 | Waters et al. | 73/40.5 R |
| 3,324,951 | 6/1967 | Balmer et al. | 166/87 |
| 3,404,736 | 10/1968 | Nelson et al. | 166/85 |
| 3,735,813 | 5/1973 | Mack et al. | 166/188 |
| 3,897,824 | 8/1975 | Fisher | 166/188 |

*Primary Examiner*—James A. Leppink
*Attorney, Agent, or Firm*—A. Joe Reinert; F. Lindsay Scott

[57] ABSTRACT

A blowout preventer test plug for use in pressure testing a blowout preventer, the plug comprising a first body having fluid passage ports positioned therethrough and a second body having fluid passage ports positioned therethrough positioned on a tubular extension below the first body so that when the first and second bodies are moved into mating contact the fluid passage ports are closed and a seal is urged into sealing contact between a tubular extension of the first body and the inner diameter of a wellhead bore in which the plug is positioned.

6 Claims, 3 Drawing Figures

BLOWOUT PREVENTER TESTING APPARATUS

BACKGROUND OF THE INVENTION

1. Field of the Invention

This invention relates to apparatus for pressure testing blowout preventers and more particularly to improvements in wellhead test plugs of a type comprising a body which is lowerable on a pipe string into the bore of a wellhead connected beneath the blowout preventer so as to seal thereagainst when so lowered so that closure means on the preventer may be extended into sealing engagement about the pipe string to enclose an annular space thereabout into which fluid under pressure may be introduced in order to test various parts of the blowout preventer.

2. Brief Description of Prior Art

Blowout preventers are used during underwater drilling operations and are provided at the wellhead to prevent uncontrolled escape of natural gas and/or crude oil from within the well which would occur otherwise at the stage in a drilling operation at which the pressure in the well exceeds the pressure at the drill bit which is known as the "mud pressure" and which is the pressure of the column of water and other matter that extends upwards from the drill bit to the surface. Also a blowout preventer serves to retain the gas and/or oil within a well once the well has been drilled.

Wellhead test plugs are adapted to be fitted to the end of a pipe string, such as the drill bit support column, in place of the drill bit, (optionally such plugs may be positioned in a pipe string above the drill bit so that the test plug can be used without completely removing the pipe string and drill bit from the well) so that they can be inserted into the bore of the wellhead and removed from that bore by respectively lowering and raising the drill bit support column. Also such wellhead test plugs are adapted to be seated upon an annular shoulder or similar abutment within the bore of the wellhead when they have been inserted in the bore of the wellhead and are positioned to seal that bore upstream of (usually beneath) the blowout preventer, and include a sealing ring which is adapted to engage the bore of the wellhead to effect the seal. Such an annular shoulder or similar abutment forms part of a conventional wellhead and its purpose does not need to be explained for a proper understanding of this invention.

In one prior apparatus a cup-type packer is carried about the body for direct sealing engagement with the bore of the wellhead. However, when the plug is installed in an underwater wellhead the close fit of the packer within the riser pipe above the preventer stack which is necessary in order to permit the packer to seal against the wellhead bore makes it necessary to raise and lower the apparatus at a very slow rate.

In another prior apparatus shown in U.S. Pat. No. 3,177,703 an annular seal assembly is carried by a body for lowering into an annular space between the bore of the wellhead and a casing hanger supported therein, in order to seal with respect to both the bore and the outside of the hanger. A cup-type packer is also carried by the body for sealing against the inside of the casing hanger whereby the body is effectively sealed with respect to the wellhead bore and both the seal assembly and preventer may be pressure tested. Although well fluid may be permitted to bypass the seal assembly and thereby enable the body to be raised and lowered more rapidly, it has been found that if the seal between the outer side of the seal assembly and the wellhead bore fails to hold test fluid pressure, such pressure upon leaking into the annulus between the wellhead bore and the casing string suspended from the hanger, can cause the casing string to collapse.

In another prior apparatus shown in U.S. Pat. No. 3,897,824 a seal is carried about the outer portion of a body which includes a sleeve whereupon the seal is slideable to a portion of the sleeve having an expanded diameter so that the seal is urged into contact with the wellhead bore. The device is relatively complex and includes valves and a plurality of sliding members and shear pins.

As a result of the continued use of blowout preventers, on subsea wells in particular, and the necessity for testing such preventers frequently a continuing search has been directed to the development of a relatively simple yet highly reliable blowout preventer wellhead test plug apparatus.

SUMMARY OF THE INVENTION

According to one aspect of this invention there is provided a wellhead plug which includes a passage through the plug which is open when a secondary body is retained in one position relative to a main body so that water and other fluid matter in the bore of the wellhead can flow through that passage during insertion of the plug into the bore and removal of the plug from the bore, and shut off means for closing the passage through the plug when a circumferential sealing ring on the main body is expanded into sealing engagement with the bore of the wellhead, wherein the passage through the plug is formed by at least one passage through the main body, at least one passage through the secondary body and a space between the two bodies which places the passages in the main and secondary bodies in communication with each other when the secondary body is retained in said one position relative to the main body by the releasable fastening means, the shut-off means comprising co-operating parts of the main and secondary bodies which are moved into fluid tight inter-engagement by movement of the secondary body relative to the main body to expand the sealing ring into sealing engagement with the bore of the wellhead, the passage or passages in the main body being isolated from the passage or passages in the secondary body by such fluid tight inter-engagement of the co-operating parts of the main and secondary bodies.

DESCRIPTION OF PREFERRED EMBODIMENTS

In the discussion of the drawings the same numbers will be used throughout to refer to same or similar components.

Figure 1:
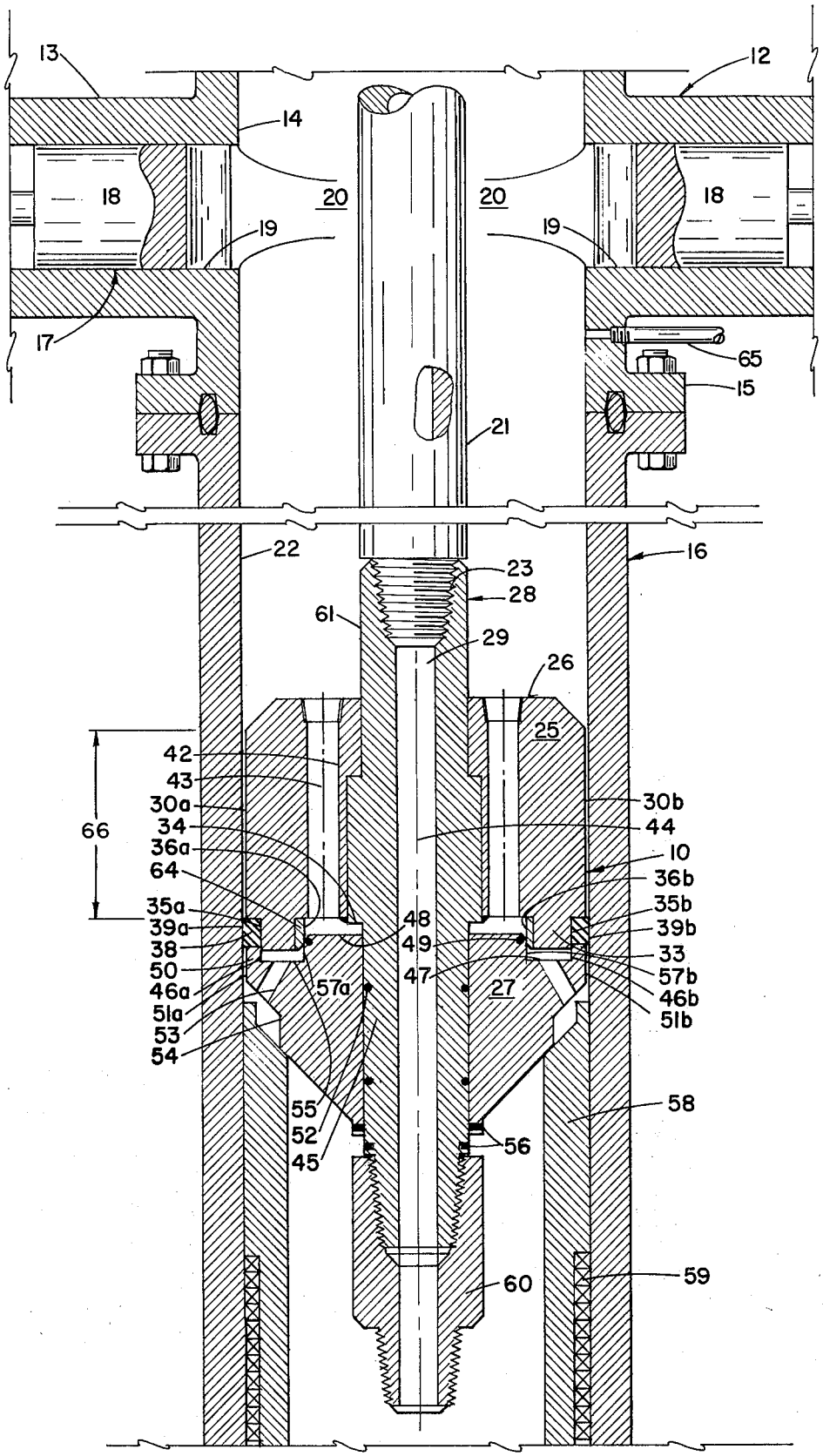
FIG. 1 is a vertical cross-sectional view of an embodiment of the present invention showing the apparatus of the present invention positioned within the bore of a wellhead, the view being vertically interrupted to illustrate in its upper portion a blowout preventer connected above the wellhead and in its lower portion the apparatus landed upon a casing seal assembly within the lower portion of the wellhead bore.

With respect to FIG. 1 the wellhead test plug of the present invention, generally referred to by the arrow 10, is shown positioned beneath a wellhead blowout protector or blowout preventer, shown generally by the arrow 12. Blowout preventer 12 comprises a housing 13 which includes a housing bore 14 which is joined by a connector 15 (connector 15 is shown as a flanged connector for simplicity although hydraulic connectors and the like are commonly used, especially in subsea installations) to a wellhead 16. Blowout preventer housing 13 includes closure means shown generally by the arrow 17, which comprises a pair of rams 18 positioned in cylinders 19 which when activated are adapted to move from cylinders 19 out through guideways 20 to sealingly close about a pipe string 21. Wellhead 16 includes a wellhead bore 22 having a diameter substantially equal to the diameter of housing bore 14.

Plug 10 comprises a main first body means 25 and a secondary second body means 27 each of which has an outer diameter slightly smaller than the inner diameter of wellhead bore 22, so that plug 10 may be raised and lowered in wellhead bore 22. Plug 10 is conveniently connected at its upper end 26 to pipe string 21 by a connector means 28 shown as mating threads 23 on pipe string 21 and upper end 26 of first body 25 in FIG. 1, so that plug 10 may be raised and lowered in wellhead bore 22.

A fluid passageway 29 is axially positioned through first body 25 and in fluid communication with pipe string 21. A first tubular extension 33 is positioned on a lower end 34 of first body 25 as positioned for use. First tubular extension 33 has an outer diameter 35 (shown as the distance between **35*a* and 35*b*) smaller than the outer diameter 30 (shown as the distance between 30*a* and 30*b*) of first body 25 and an inner diameter 36 (shown as the distance between 36*a* and 36*b*) greater than the diameter of fluid passageway 29. First body 25 also includes at least one passageway or port 42 communicating through first body 25 with the axis 43 of port 42 being disposed substantially parallel to the axis 44 of first body 25 and terminating between inner diameter 36 of first tubular extension 33 and the outer diameter of passageway 29. A circular seal means 38 is positioned about outer diameter 35 of first tubular extension 33 with circular seal means 38 having an outer diameter 39 (shown as the distance between 39*a* and 39*b*) which is equal to or slightly less than outer diameter 30 of first body 25. A second tubular extension 45 is also positioned on lower end 34 of first body 25 with passageway 29 extending axially through second tubular extension 45. Desirably first body 25 has an axial length 66 along its outer diameter greater than the diameter of cylinders 19 so that plug 10 will pass smoothly past the openings of cylinders 19**.

Second body 27 is slidably mounted on second tubular extension 45 and contains a mating circular groove or recess 47 on its upper end 48 as positioned for use. Groove 47 is of a width and depth to mate with first tubular extension 33 on first body 25. A sealing means shown as an 0-ring 49 is positioned to seal between inside diameter 36 of first tubular extension 33 and the inner diameter 57 (shown as the distance between **57*a* and 57*b*) of groove 47 when first tubular extension 33 and groove 47 are mated. The portion 50 of second body 27 between the outer diameter 46 of groove 47 (shown as the distance between 47*a* and 47*b*) and the outer diameter 51 (shown as the distance between 51*a* and 51*b*) of second body 27 is adapted to compress circumferential seal means 38 when first body 25 and second body 27 are moved into mating engagement. A seal means shown as an 0-ring 52 between second body 27 and second tubular extension 45 is provided to prevent fluids from passing between second body 27 and second tubular extension 45. Second body 27 includes at least one passageway or port 53 communicating through second body 27. More particularly port 53 communicates between a lower portion 55 of groove 47 and a lower end 54 of second body 27**.

A releasable fastening means shown as a shear pin 56 joining second tubular extension 45 and second body 27 is provided for retaining second body 27 in an unmated position until second body 27 is dislodged into mating engagement with first body 25 by pressure applied to second body 25 along axis 44 of first body 25 and second body 27. A retaining means 60 is positioned on second tubular extension 45 to retain second body 27 in position on tubular extension 45. Retaining means 60 prevents second body 27 from sliding off second tubular extension 45 when pipe string 21 is raised after shear pin 56 has been sheared to permit second body 27 to move into mating engagement with first body 25. Retaining means 60 is shown in FIG. 1 as a fitting. Retaining means 60 may also be formed as an enlarged portion of tubular extension 45 or the like.

In FIG. 1 plug 10 is shown in position in wellhead 16 in a closed position. Lower end 54 of second body 27 rests on an annular shoulder in wellhead 16 shown as a seal assembly 58 which is positioned over a seal 59.

As known in the art and as shown in the aforementioned U.S. Pat. No. 3,177,703 one or more casing hangers (not shown) may be landed within wellhead bore 22 for suspending casing strings therein. More particularly these casing hangers are of the type which define openings through an annular space between each hanger and the wellhead bore to permit cement returns to pass upwardly therethrough as a casing suspended from the hanger is cemented in the wellbore. Following circulation of cement returns through the openings they are closed by means of a seal assembly 58 lowered into the annular space and having a seal 59 about its outer side for sealing it with respect to the wellhead bore. Another portion (not shown) of the seal assembly is adapted to seal with respect to the casing hanger so that, as will be understood, leakage of pressure fluid downwardly past seal 59 could cause the casing suspended from the casing hanger to be collapsed.

Figure 2:
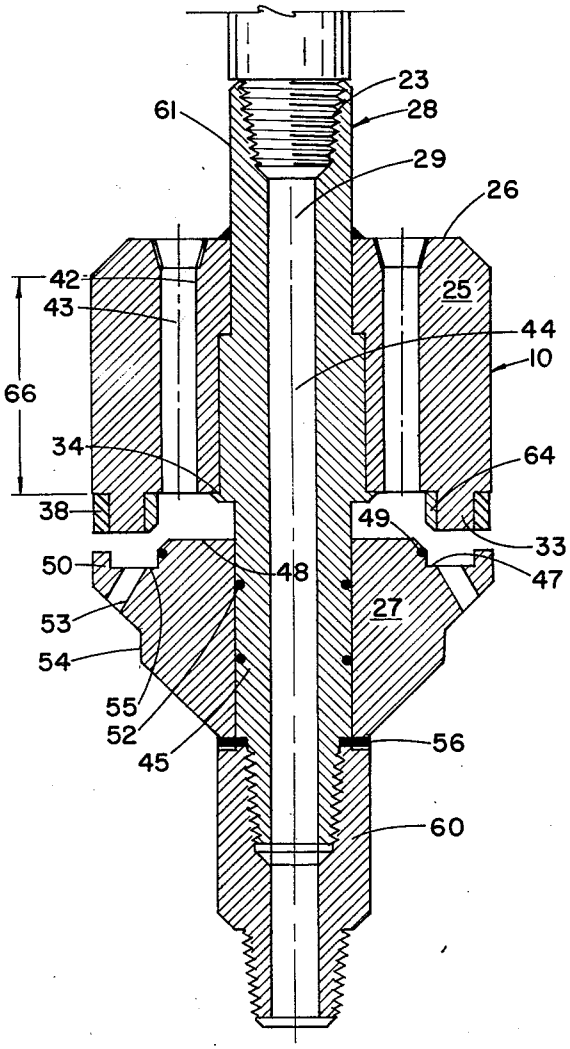
FIG. 2 is a cross-sectional view of an embodiment of the apparatus of the present invention in an open position.

FIG. 2 shows the apparatus of FIG. 1 in an open position.

In the fabrication of plug 10 it will be obvious to those skilled in the art that first body 25 is readily fabricated as a single component although in practice it may be found desirable to position a metal section from which first body 25 is to be machined on a mandrel 61 and thereafter machine the material to the configuration desired in first body 25. Obviously a variety of fabrication techniques can be used and so long as first body 25 is formed as described herein it is believed that any such fabrication methods are suitable.

Figure 3:
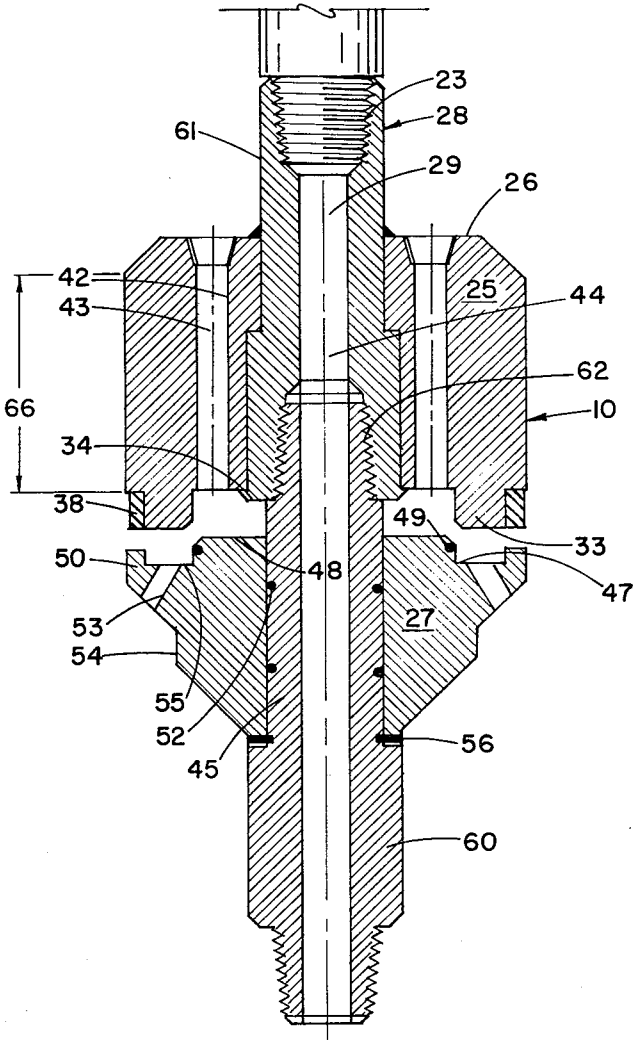
FIG. 3 is a cross-sectional view of a further embodiment of the apparatus of the present invention in an open position.

FIG. 3 shows a variation of plug 10, whereby mating threads 62 are positioned to allow second tubular extension 45 to be removed from first body 25 thereby facilitating the replacement of shear pin 56. This modification in some instances permits shear pin 56 to be more readily replaced and the like.

In a further variation it has been found desirable to use inserts on the surface forming inner diameter 36 of first tubular extension 33. Such inserts are desirably of a non-corrosive material such as stainless steel or the like. The use of such inserts has been found beneficial in some instances although the use of the inserts is not considered essential to the operation of the present invention.

Operation

In the practice of the present invention, test plug 10 in an open position as shown in FIG. 2 is lowered using pipe string 21 into wellhead bore 22 until lower end 54 of second body 27 engages an annular shoulder or similar abutment which forms a part of conventional wellhead 16. The presence of abutments, annular shoulders, or the like is common in wellheads since such abutments, shoulders, and the like are used for the positioning of casing in the wellhead and a variety of other purposes. Such an annular shoulder is shown as seal assembly 58 in FIG. 1. Engagement of lower end 54 and seal assembly 58 effectively stops the downward motion of plug 10 into wellhead bore 22. Plug 10 is sized to pass freely but with narrow clearance through wellhead bore 22 and housing bore 14 of blowout preventer 12 so that it may be readily lowered into wellhead bore 22. Fluid is allowed to pass upwardly through plug 10 through ports 42, between second body 27 and first body 25 and through ports 53, as plug 10 is lowered into position. As plug 10 is lowered into position it is maintained in an unmated or open position as shown in FIG. 2 by shear pin 56 which, as will be understood, may be one or a plurality of shear pins as required. When plug 10 is in position as shown in FIG. 1 a continued downward motion of pipe string 21 causes shear pin 56 to shear and allows plug 10 to move into a mated or closed position as shown in FIG. 1. In particular, second body 27 moves upwardly along second tubular extension 45 and into engagement with first body means 25. More particularly mating groove 47 moves into mating engagement with first tubular extension 33 and portion 50 moves into compressing engagement with circular seal means 38. The passage of fluids through plug 10 is prevented by the sealing junction of groove 47 and first tubular extension 33 and by 0-ring 49 between second body 27 and second tubular extension 45. The portion 50 of second body 27 between the outer diameter of 51 of second body 27 and the outer diameter of mating groove 47 moves into compressing contact with circular seal 38 and compresses circular seal 38 into sealing engagement with wellhead bore 22 and outer diameter 35 of first tubular extension. Wellhead bore 22 is thus completely sealed and blowout prevented 12 may now be closed and pressure introduced into the space between blowout preventer 12 and plug 10 by way of a line 65 for introducing fluids. As will be clearly seen the compression of seal 38 is to the extent necessary to form a sealing engagement of seal 38 with wellhead bore 22 and outer diameter 35 of first tubular extension 33 since first tubular extension 33 and mating groove 47 are shaped to mate to a depth sufficient to allow compression of circular seal 38 to an extent greater than necessary to form the sealing engagement. Thus the weight to first body 25 and pipe string 21 is used to exert sufficient force to compress circular seal 38 to the extent necessary to form an effective sealing engagement. Seal 38 is of materials known to those skilled in the art for such sealing purposes and is suitably made from rubber, synthetic rubbers, re-enforced rubbers and the like. Particular desirable results have been achieved wherein rubbers having a durometer rating from 70 to 80 were used. Plug 10 is effective in sealing against wellhead bore 22 even when irregularities are present in wellhead bore 22. It has been found desirable that seal 38 have a rectangular cross-section and while the outer diameter 39 of seal 38 may be substantially equal to outer diameter 30 of first body 25 it is desirable that outer diameter 39 of seal 38 be formed to have an outer diameter 39 slightly less than outer diameter 30 of first body 25. Such is desirable in that it prevents damage to seal 38 during passage downwardly through blowout preventer housing bore 14 and wellhead bore 22, so that seal 38 is intact when plug 10 reaches the point at which sealing engagement is to be accomplished. Desirably seal 38 is of a length substantially equal to that of second tubular extension 33, although clearly seal 38 can have a lesser length since groove 47 and first tubular extension 33 can mate to varing depths with respect to movement of first tubular extension 33 into groove 47 axially along axis 44.

After plug 10 has been placed in position and mated or moved to a closed sealing position as shown in FIG. 1, blowout preventer 12 can be tested. The blowout preventer test is conducted by closing blowout preventer rams 18 about pipe string 21 and introducing fluid under pressure into the space between plug 10 and blowout preventer 12 by way of a pipe 65, in order to test blowout preventer 12. If test pressure should leak past seal 59 it is readily relieved through passageway 29 and pipe string 21 so that even if seal 59 of seal assembly 58 were also defective there would be no danger of the test pressure flowing into the annulus between the casing hanger to which seal assembly 58 is connected and the portion of wellhead bore 22 thereabout. In some instances it may be desirable to position weep ports or the like on lower end 54 of second body 27 to allow any fluids which may leak past seal 38 to pass into passageway 29.

Upon completion of the tests the rams 18 are retracted and pipe string 21 is lifted to raise plug 10. Upon raising pipe string 21, plug 10 is urged upwardly and since second body 27 is slideable along second tubular extension 45 it moves to an open or unmated position, as shown in FIG. 2, so that seal 38 is removed from sealing engagement with wellhead bore 22 and plug 10 is retracted to its unmated or open and non-sealing position for removal from wellhead bore 22. Second body means 27 is retained on second tubular extension 45 by a retaining means shown as a fitting 60 which is positioned on second tubular extension 45 beneath second body 27.

Plug 10 is formed of metals and materials commonly used in the fabrication of oil field equipment such as ferrous alloys and the like. Such materials are well known to those skilled in the art and need not be discussed further.

If desired, lower end 54 of second body 27 may be shaped to matingly seat on an annular shoulder or the like positioned in wellhead 16 since the configuration of the annular shoulder or the like will vary as is known to those skilled in the art. Such variations in the shape of lower end 54 are considered within the scope of the present invention.

Having thus described the present invention with respect to its preferred embodiments it is pointed out that many variations and modifications are possible within the scope of the present invention and it is contemplated that many such variations and modifications within the scope of the present invention may be considered obvious or desirable to those skilled in the art upon a review of the foregoing description of the preferred embodiments.

Having thus described the invention I claim:

1. A blowout preventer test plug for use in pressure testing a blowout preventer which includes a housing having a housing bore axially formed therethrough and sealably connected to the upper end of a wellhead with said housing bore forming an upward continuation of a wellhead bore through said wellhead and closure means mounted within the housing for extension into said housing bore to seal about a pipe string therein, said plug comprising;

a. a first cylindrical body having an outer diameter slightly smaller than the diameter of said housing bore and said wellhead bore, an axially disposed fluid passageway therethrough and a support means positioned on the upper end of said first body, as positioned for use, for supporting said first body from said pipe string so that it may be raised and lowered within said housing bore and said wellhead bore;

b. a first tubular extension on the lower end of said first body as positioned for use and having an outer diameter less than said outer diameter of said first body and an inner diameter greater than the diameter of said passageway;

c. a circumferential seal means disposed about the outer diameter of said first tubular extension and having an outer diameter substantially equal to or slightly less than said outer diameter of said first body;

d. at least one port communicating through said first body with the axis of said port disposed substantially parallel to the axis of said first body and terminating between the inner diameter of said first tubular extension and the outer diameter of said passageway;

e. a second tubular extension on said lower end of said body, said passageway in said first body extending axially through said second tubular extension;

f. a second cylindrical body slideably positioned on said second tubular extension beneath said first body and having an outer diameter slightly smaller than the diameter of said housing bore and said wellhead bore and a mating circular groove on the upper end of said second cylindrical body, as positioned for use, of a depth and width to mate with said first tubular extension on said first body;

g. means for sealing between the inside of said first tubular extension and said mating groove when said first tubular extension and said mating groove are mated, the portion of said second body between the outer diameter of said circular groove and said outer diameter of said second body being adapted to compress said circumferential seal means when said first tubular extension and said mating groove are mated;

h. means for sealing between said second body and said second tubular extension;

i. at least one port communicating between the bottom portion of said groove and the lower end of said second body as positioned for use; and, j. retaining means for retaining said second body in position on said second tubular extension.

2. The test plug of claim 1 wherein said test plug includes a releasable fastening means for retaining said second body in an unmated position until said second body is dislodged into mating engagement with said first body by pressure applied to said second body along the axis of said first and said second body means.

3. The test plug of claim 2 wherein said releasable fastening means comprises a shear pin for maintaining said second body in a fixed position relative to said first body.

4. The test plug of claim 1 wherein said first body means has an axial length along its outer diameter greater than the diameter of the openings in said housing bore for the extension of said closure means into said housing bore.

5. The test plug of claim 1 wherein said circumferential seal means has a length substantially equal to the length of said first tubular extension.

6. The test plug of claim 1 wherein said retaining means is positioned on said second tubular extension beneath said second body to retain said second body on said second tubular extension when said test plug is raised after said second body has been dislodged into mating engagement with said first body.

* * * * *